US005194114A

United States Patent [19]

Walter

[11] Patent Number: 5,194,114

[45] Date of Patent: Mar. 16, 1993

[54] MEANS FOR MAKING A SEALED ENVELOPE

[75] Inventor: Bernd H. Walter, Naples, Fla.

[73] Assignee: GBR Systems Corporation, Naples, Fla.

[21] Appl. No.: 710,543

[22] Filed: Jun. 5, 1991

[51] Int. Cl.[5] ..... B43M 5/04

[52] U.S. Cl. ..... 156/442.1; 156/227; 156/442.2; 156/443; 156/578; 118/32; 118/44; 118/315; 271/209; 493/266; 493/420

[58] Field of Search ..... 156/441.5, 442.1, 442.2, 156/227, 578, 443; 118/32, 315, 44; 229/80; 493/264, 266, 420; 271/209

[56] References Cited

U.S. PATENT DOCUMENTS

| | | | |
|---|---|---|---|
| 2,029,922 | 2/1936 | Heckel et al. | 118/44 |
| 4,104,983 | 8/1978 | Carstedt | 118/32 X |
| 4,540,458 | 9/1985 | Baughman et al. | 156/312 |
| 4,732,375 | 3/1988 | Tetherton | 271/209 X |
| 4,799,989 | 1/1989 | Marzullo | 156/442.1 |
| 4,819,930 | 4/1989 | Jackson et al. | 271/209 |
| 5,048,809 | 9/1991 | Tebbe et al. | 118/32 X |

FOREIGN PATENT DOCUMENTS

| | | | |
|---|---|---|---|
| 60-2565 | 1/1985 | Japan | 271/209 |

*Primary Examiner*—David A. Simmons
*Assistant Examiner*—Mark A. Osele
*Attorney, Agent, or Firm*—Stoll, Previto & Hoffman

[57] ABSTRACT

A mechanism for applying adhesive to a sheet comprising a plurality of glue applicators comprising valves or nozzles adapted to form a charge of adhesive at the tip of each. The sheet is moved toward the nozzles to permit adhesive spots to be deposited on the sheet. The nozzles have periods of deactivation after which they are reactivated. A cleaning and moistening sponge (or a tray with appropriate fluids) is provided to maintain the adhesive in the nozzles in usable condition during periods of deactivation so that the adhesive may be immediately used and deposited on the sheet upon reactivation of the nozzles.

36 Claims, 7 Drawing Sheets

MEANS FOR MAKING A SEALED ENVELOPE

BACKGROUND

The present invention relates to an improved means for making an envelope and, more particularly, to an improved means of sealing the open edges of an envelope blank while folding it around an insert to form a mailable letter.

The invention is adapted for rapid application and precision control of the volume and pattern of the adhesive to assure quick sealing of the envelope. The present system is particularly adapted to be used with a roller folding machine to create a mailing piece in one single passage. In addition, the present invention is adapted to insure that the nozzles for applying glue to the glue flap of the envelope (or to any other piece of paper) remain in a clean and usable condition so that they may be used immediately when they are needed.

The present state of art consists of a variety of methods for depositing an adhesive bead directly onto the paper. This requires extremely precise timing to avoid the possibility of squirting the adhesive bead into and onto unwanted areas. Those systems require comparatively low paper speed and have inherent clean-up problems. In high speed production of envelopes, glue nozzles are used to glue the envelope seal flap panel and the various other panels together. It is important that the glue nozzles be available to apply glue the instant that the glue is needed. Hence, if for some reason the glue nozzles remain inactive or in a deactivated condition for a period of time, glue in the glue nozzle may harden so that the glue is not available immediately when it is needed. This creates lost time which is counterproductive to modern high speed envelope forming methods.

In general, the system consists of a pressurized and controlled adhesive distribution system. In accordance with the present invention, an envelope is formed from a blank sheet of paper having a center panel, a front panel, a rear panel. It may also have a separate seal flap panel attached to the front panel. The panels are adapted to be folded relative to each other to form the envelope. The edges of the envelope are adhered together and the front panel is adhered to the previously-folded rear panel in order to complete the security of the envelope. If a seal flap is present, the seal flap is folded over and adhered to the previously folded center panel. The sheet of paper is first moved beneath an adhesive-depositing mechanism which deposits adhesive onto opposed side edges of the blank sheet. Another adhesive-depositing mechanism deposits spots of adhesive onto the inner surface of the last panel to be folded (whether it be the front panel or the seal flap panel). The envelope is then moved back into a folding mechanism which first folds the various panels relative to each other to permit the side edges of the panels to be adhered together and the last panel to be folded to be adhered to a previously folded panel.

Spaced nozzles (preferably seven) are provided to deposit shaped beads of adhesive onto the inner face of the last panel to be folded. A series of defector ramps are positioned below a glue manifold and its glue applicator nozzles. As the front edge of the sheet of paper to be sealed passes below the row of nozzles (with a measured charge or bubble of adhesive formed from and suspended on each tip), it encounters the series of deflector rams which deflect it upward. The front edge also strikes a front folder plate stop which forces the paper to bow or buckle upwardly and into contact with the adhesive droplets or charges on the nozzle tips so that they are deposited onto the paper surface. The paper is then retracted back and away from the front folder plate stop which causes the bow or buckle to disappear and causes the paper to drop away from the nozzles leaving the droplets firmly deposited on the surface inwardly spaced from the front edge thereof.

In addition, the present invention keeps the glue in the nozzles in a moist soft and usable condition during the time where the nozzles are inactive or in a deactivated condition so as to prevent it from hardening and keep it in condition for immediate deposition on the seal flap panel when the nozzles are reactivated. This may be accomplished by placing the nozzles in an environment which prevents air from accessing the nozzle tips and drying the adhesive (preferably a moist environment) for the length of time that the nozzles are inactive (in a deactivated state) and are not feeding glue. This prevents the glue at the tip of the nozzles from hardening.

The present invention produces an inexpensive generated piece of mail produced at a very high speed on a system specifically designed to convert one sheet of paper into a sealed, letter-like piece of mail acceptable by and meeting post office regulations.

BRIEF DESCRIPTION AND OBJECTS

The glue system of the present invention features control thereof by a controller which provides the signals and glue position time of the glue applicators to apply the glue to the sides of the document and also provides the timing to form seven glue dots or charges on the seal flap panel as well as providing the needed control to keep the glue nozzles moist.

As discussed above, the system consists of a deflector ramp, or a series thereof, mounted within a folding plate and a series of nozzles (manifold or individual) strategically placed above the deflector line. During the folding process, the leading edge of the paper to have glue applied thereto enters the gluing station, guided by walls or rods to follow the given path. Just prior to reaching a front stop, the leading edge passes under a row of stationary nozzles with a bubble or charge of adhesive suspended from each—without actually touching any since they are suspended just above the paper path.

However, just as the leading edge passes the nozzles, it encounters the slope of deflectors and also strikes the front stop which forces the paper to bow or buckle upwardly thus bringing the surface of paper in contact with the adhesive bubbles or charges on the nozzles, creating a plurality of dots of adhesive on the panel to be sealed. Immediately the paper retracts which causes the bow to disappear and the paper to move away from the nozzles without "smearing" any adhesive over the paper edge, which is important to the clean operation of the folder.

The present invention also achieves low operator maintenance. Whenever the gluing system is deactivated and is not processing documents the nozzles are moved into an environment where air is prevented from drying the glue on the nozzle tips, such as a moist sponge. A sponge (or any other liquid absorbent material) is preferably used to prevent water spillage and minimize evaporation. It provides an environment for the seven glue nozzles to slow the glue drying process and also provides a contact wiping action to clean the seven nozzle tips. The process of moving the nozzles into a moist environment when the glue nozzles are not gluing paper creates a very low maintenance panel glue system.

One object of the present invention is the provision of an improved means and method of making a sealed envelope in which all panels are adhered together in a single piece of mail.

Another object of the present invention is the provision of an improved means and method of forming an envelope in which the glue is expeditiously applied to the last panel to be folded.

Another object of the present invention is the provision of an improved means and method of forming an envelope in which there is no danger of smearing the adhesive on the panel.

Another object of the present invention is a production of an improved means and method forming an envelope in which location of the adhesive to be applied to the last panel to be folded may be easily adjusted.

Another object of the present invention is the provision of an improved method and means of forming an envelope in which glue in the nozzles is prevented from hardening.

Another object of the present invention is the provision of an improved method and means of forming an envelope in which the glue in the nozzles remains soft so that it may be immediately used when needed.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

Figure 1:
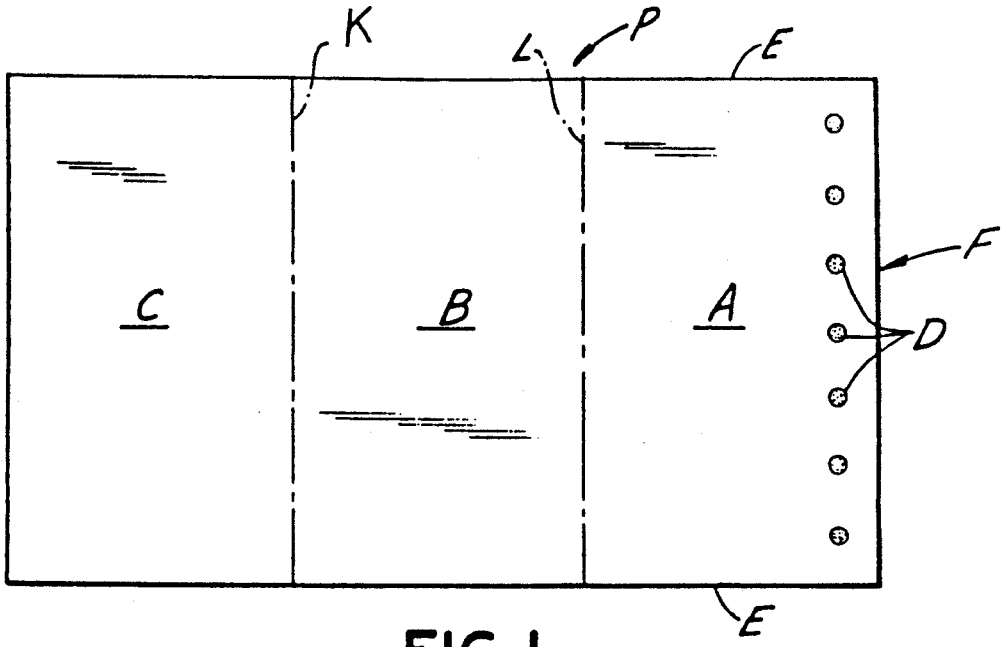
FIG. 1 is a plan view of an envelope blank made in accordance with the present invention.
Figure 1A:
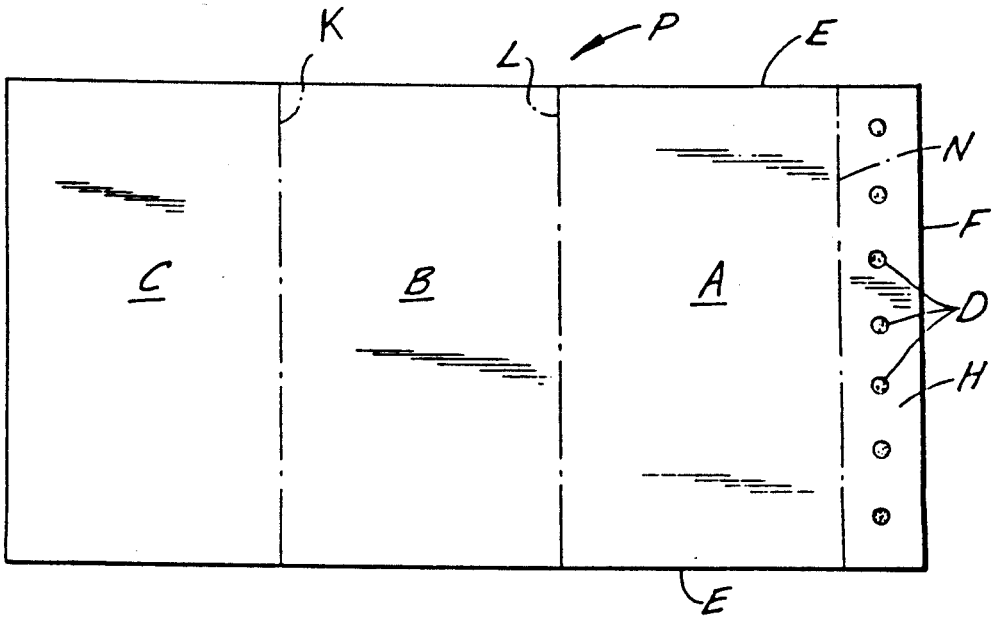

FIG. 1*a* is a plan view of another embodiment of an envelope blank which may be folded and sealed in accordance with the present invention.

Figure 2:
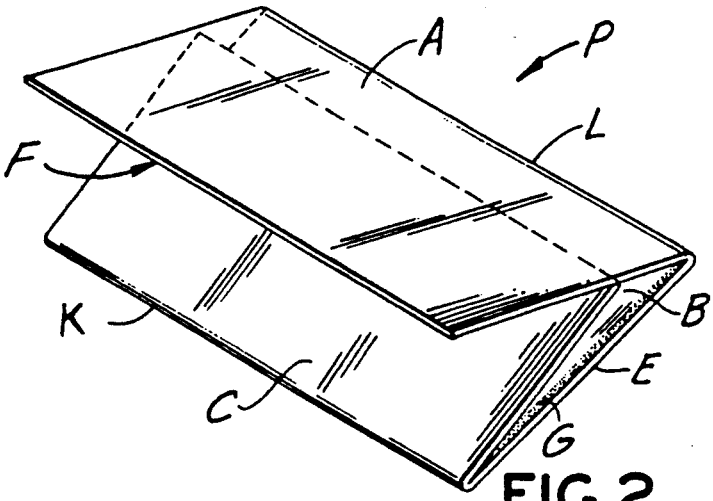
FIG. 2 is a perspective view of the envelope in its partially-folded position.
Figure 2A:
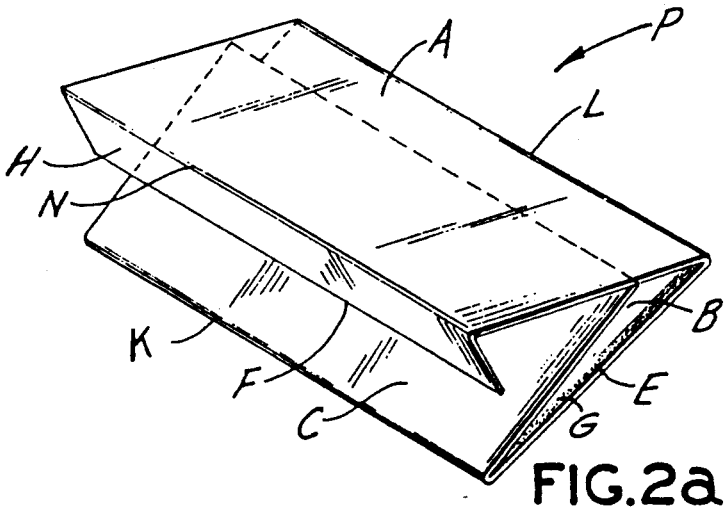

FIG. 2*a* is a perspective view of the envelope shown in FIG. 1*a* in partially folded position.

Figure 3:
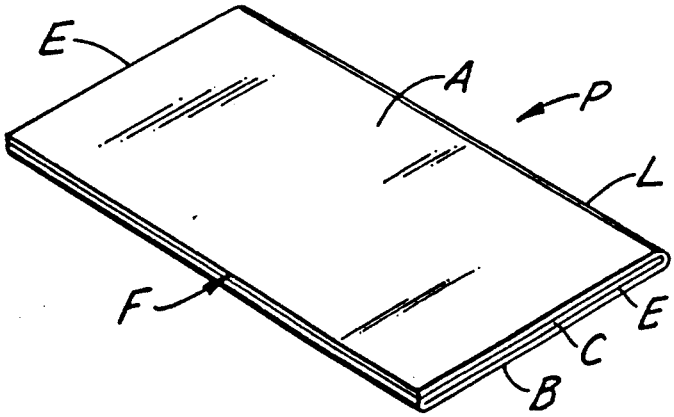
FIG. 3 is a perspective view of the envelope showing it in fully-sealed position.
Figure 3A:
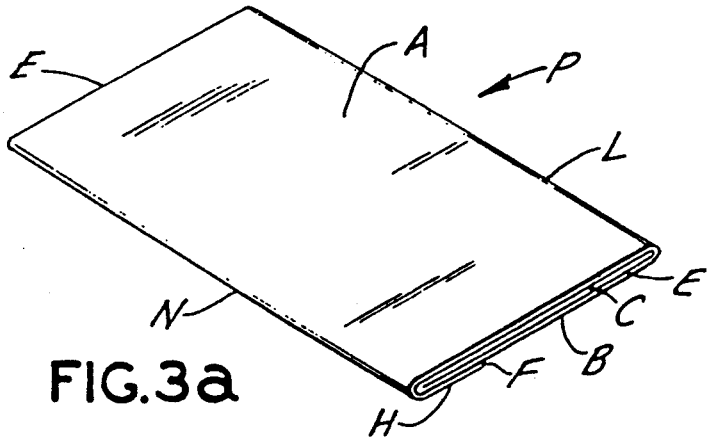

FIG. 3*a* is a perspective view of the envelope shown in FIG. 1*a* in its fully folded position.

Figure 4:
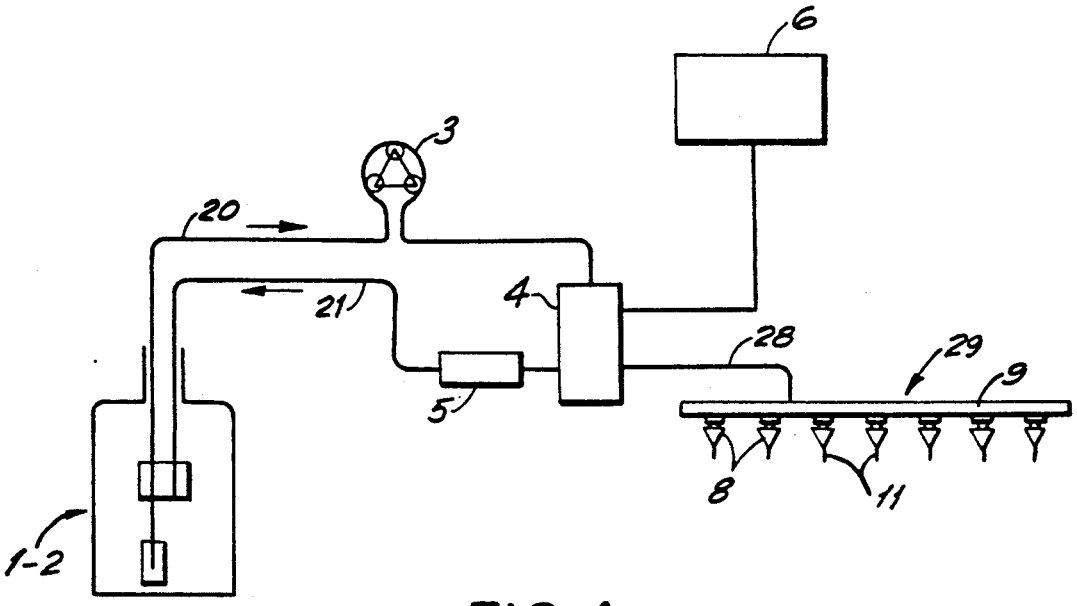

FIG. 4 is a diagrammatic view of the system of the present invention for applying the adhesive.

Figure 5:
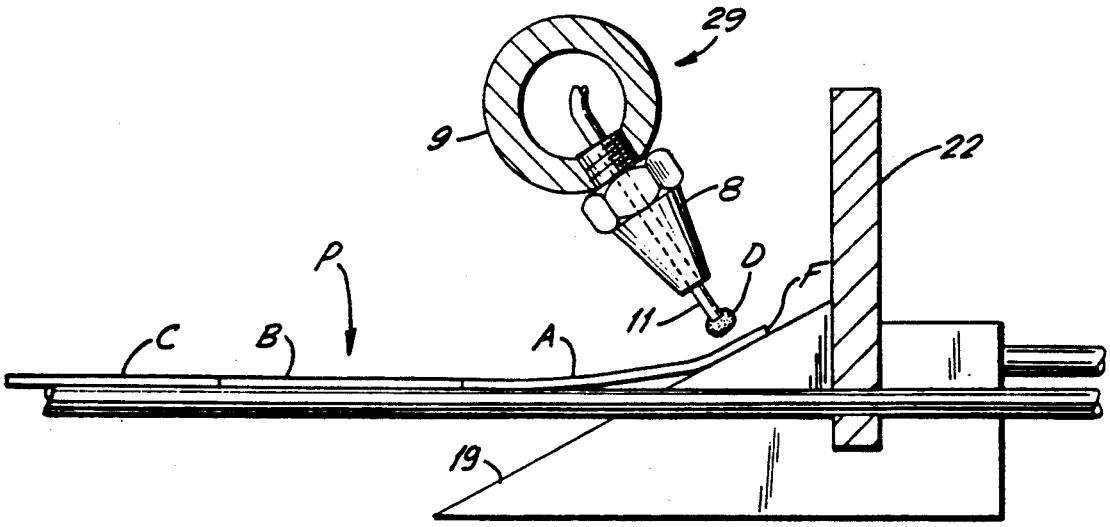

FIG. 5 is a schematic side view showing one step in the manner of applying glue to the front panel of an envelope in accordance with the present invention.

Figure 5A:
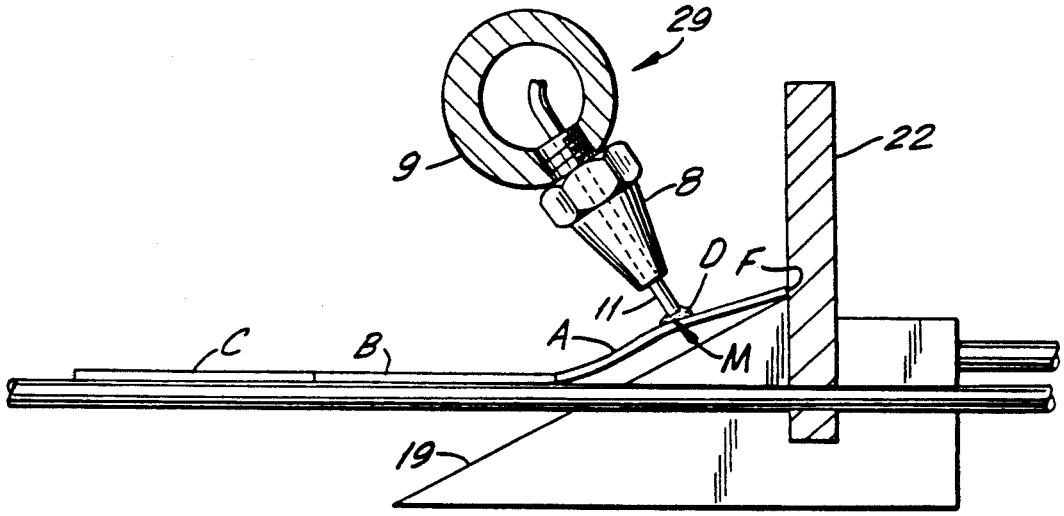

FIG. 5*a* is a diagrammatic view showing a further step in the manner of applying glue to the front panel of an envelope.

Figure 5B:
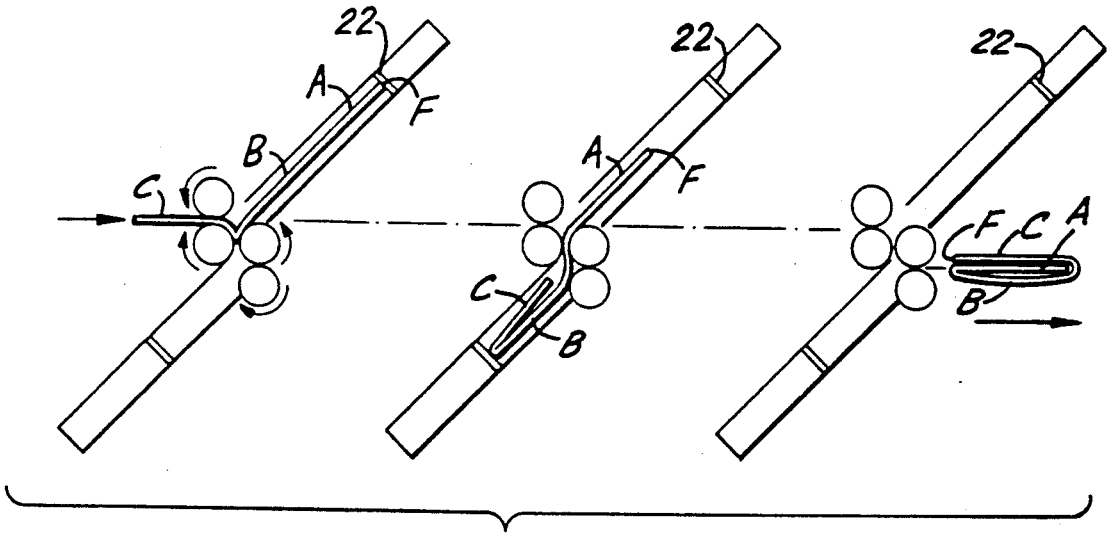

FIG. 5*b* is a diagrammatic view showing a folding mechanism for folding the blank shown in FIGS. 1 to 3 and the three steps which this folding mechanism uses to fold the blank.

Figure 5C:
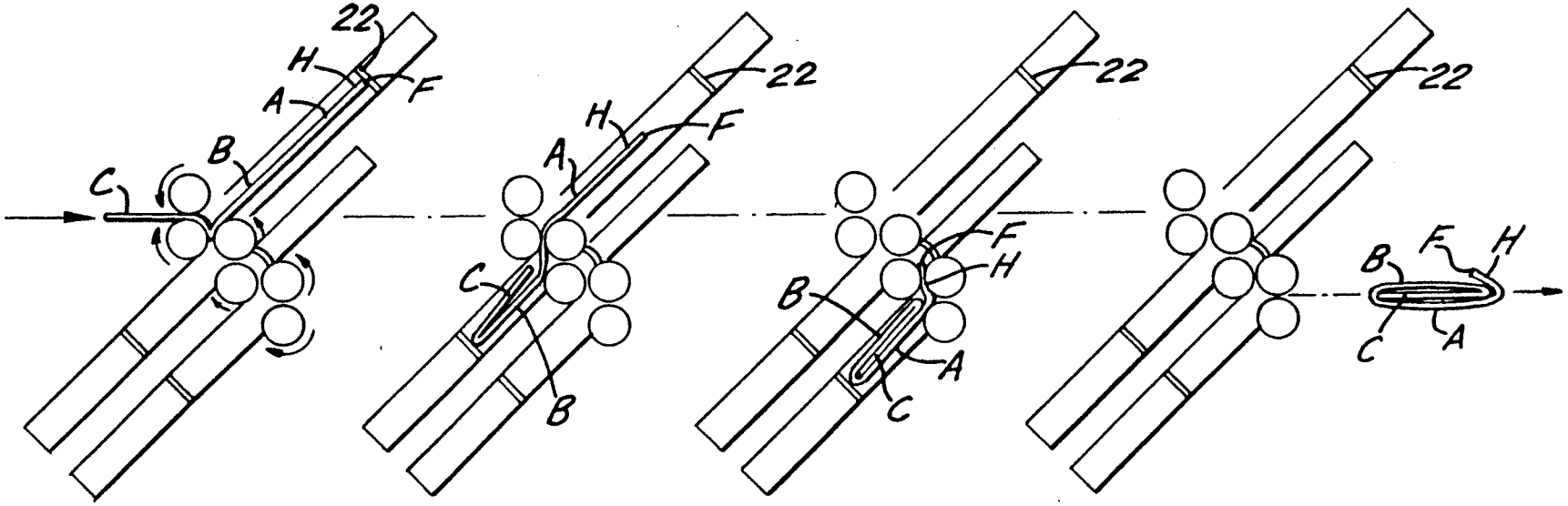

FIG. 5*c* is a diagrammatic view showing another folding mechanism for folding the blank shown in FIGS. 1*a* to 3*a* and the four steps which this folding mechanism uses to fold the blank.

Figure 6:
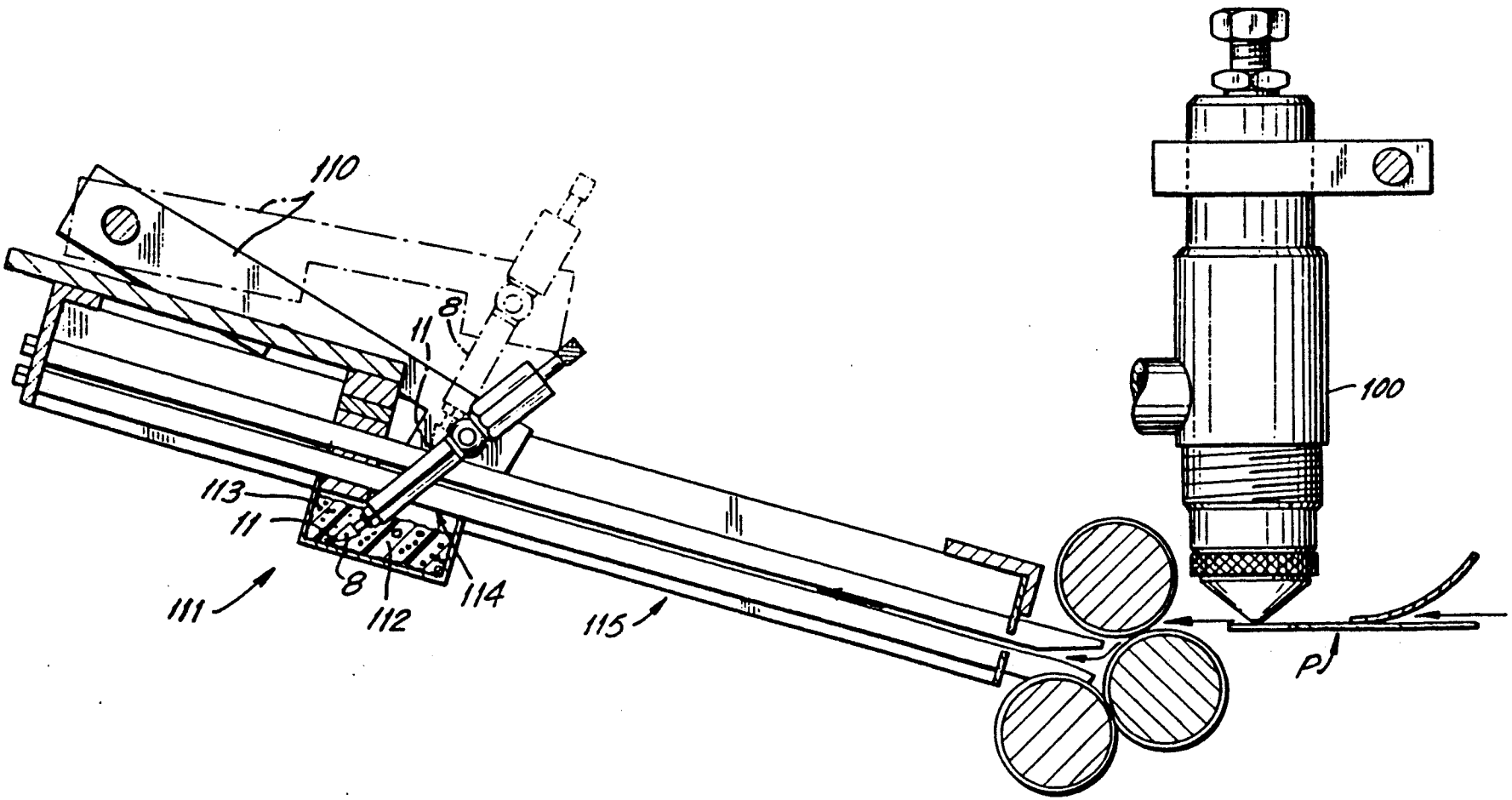

FIG. 6 is a schematic side elevational view showing the means for maintaining the tips of the nozzles in a moist condition in order to prevent the glue from hardening.

Figure 7:
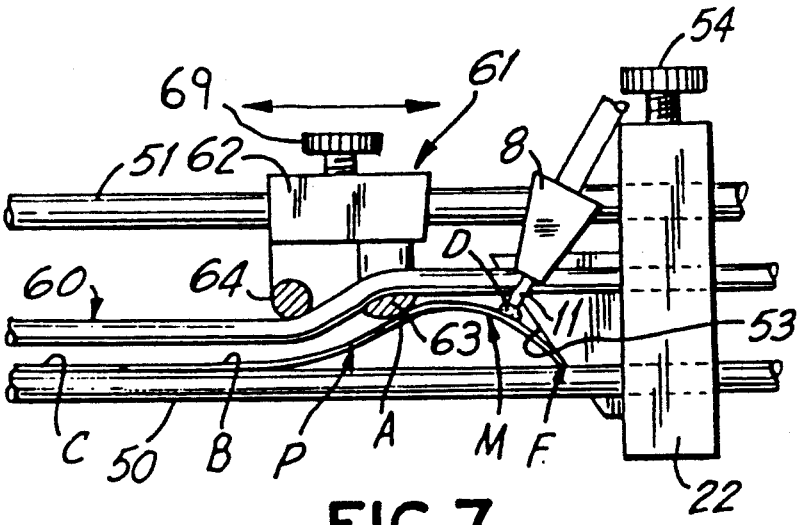

FIG. 7 is a schematic side view of another embodiment of the present invention.

Figure 8:
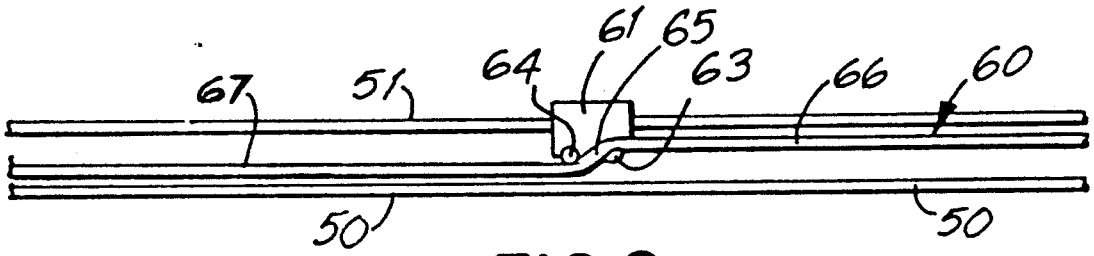

FIG. 8 is a schematic side view of the embodiment of the invention shown in FIG. 7.

Figure 9:
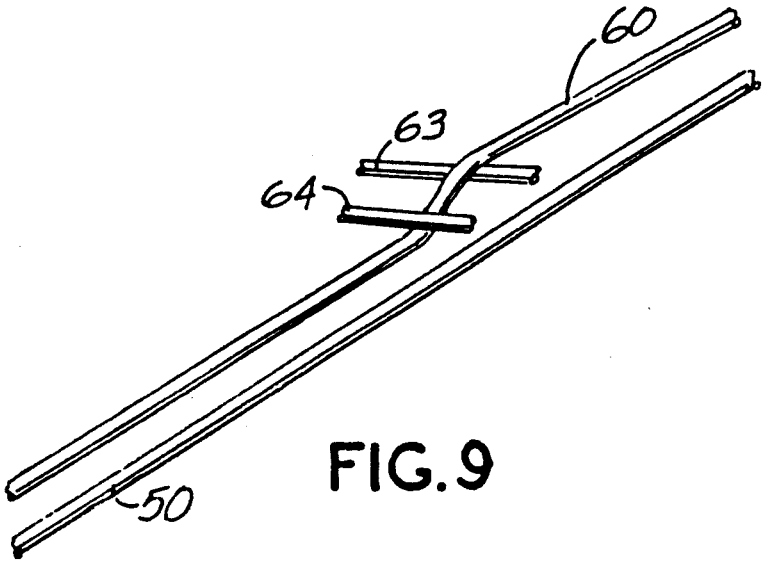

FIG. 9 is a schematic perspective view showing the manner in which the embodiment of FIG. 7 may be operated.

DESCRIPTION

Referring to the drawings and more particularly to FIGS. 1 through 3, the present invention comprises a blank sheet of paper P having a center panel B, front panel A and a rear panel C which are adapted to be folded along fold lines L and K to form the finished mailing envelope. The end edges E of the envelope are adhered together and the front panel A is adhered to the folded rear panel in order to complete the security of the envelope.

In accordance with the invention, the sheet of paper P is moved beneath an adhesive-depositing mechanism which deposits a plurality of dots or charges of adhesive D onto the inner face of the front panel A. The adhesive D is preferably deposited in seven spaced dots. The envelope is then moved back into a folding mechanism which folds the rear panel C over the center panel B and front panel A over the rear panel C. The edges E of the envelope are adhered together by adhesive G and the dots of adhesive D on the inner face of the front panel A will adhere the front panel A to the previously-folded rear panel C.

FIGS. 1*a* to 3*a* show another type of envelope which may be folded and adhered together to form a mailing piece. The sheet of paper P represents the envelope blank. The front panel A is connected to a seal flap panel H by a fold line N and is connected to the center panel B by a fold line L. The seal flap panel H has a front edge F. In this embodiment, the adhesive dots D are applied to the inner face of the seal flap panel H. The rear panel C is connected to the center panel B by another fold line K. The rear panel C is folded over the center panel B along a fold line L so that the inner faces of each are superimposed over each other. The opposed end edges E of panels B and C are sealed together by adhesive G. The front panel A is folded over the previously folded rear panel C and sealed thereto along the edge E. The seal flap panel H is then folded over and adhered to the center panel B by means of a series adhesive dots D so that it becomes adhered to the outer face of the center panel B.

The mechanism for applying the adhesive charges or spots D on the seal flap H is illustrated diagrammatically in FIG. 4. A glue reservoir assembly 1-2, which may have a strainer assembly and a recirculating drain, has glue pumped from it by a pump 3 through a supply line 20. The pump 3 pumps the glue to an electric distribution valve 4 (controlled by a computer 6) which has a return line 21 to return glue back to the glue reservoir 1-2 and a feed line 28 leading to a nozzle assembly 29. The nozzle assembly 29 preferably comprises a nozzle manifold 9 from which a plurality of nozzle units 8 depend, each of which has nozzle tips 11 thereon.

When glue is to be directed to the nozzle manifold 9, the valve 4 operates to allow glue D to flow to the nozzle manifold 9 through feed line 28. When it is desired to stop the flow of glue D to the nozzle manifold 9, the valve 4 stops operating so that glue D flows back into the reservoir assembly 1-2 through the return line 21 and through a pressure relief valve 5.

As shown in FIGS. 5 and 5*a*, when the embodiment of FIGS. 1-3 is to be folded and glued together, the blank sheet of paper P is moved into a folding mechanism shown in FIG. 5*b* (which is a well known 2-plate folder) beneath the nozzle assembly 29. The front edge F of the blank P passes under the array of the suspended nozzle tips 11, each of which has a bubble or charge of adhesive D extending therefrom. The paper P does not touch the charges of adhesive D since it is spaced therebelow. Glue is also applied to the edges E of the paper P. As soon as the front edge F strikes a deflecting ramp 19 (which may comprise a plurality thereof) and the front stop 22 the front panel A is bowed or buckled upwardly as at M (FIG. 5*a*) until its inner face strikes the adhesive charges D so that adhesive D is deposited on the inner face of the front panel A as separate dots or spots D.

The paper blank P is then retracted and folded as shown diagrammatically in the three steps 1 to 3 in FIG. 5*b* and the various panels, A, C and B are folded over each by the folding mechanism. In the initial retracting operation, the front panel A slides away from the front stop 22 so that the bow or buckle M disappears and the paper is moved away from the nozzle tips 11 with the beads D of glue thereon.

As the paper moves forward and strikes the front stop 22, the front panel A will buckle or bow upwardly as shown at M in FIG. 5*a* in order for the paper to contact the glue bead D which is at the nozzle tip 11. Glue bead D is disposited onto the inner face of the front panel A. When the paper is retracted (under the influence of the folding mechanisms shown in FIG. 5*b*) the buckle or bow M disappears and paper moves away from the nozzle tips 11 leaving the glue bead D on the paper with the paper in spaced relationship below the nozzle tip 11. Hence, during the retraction of the paper, the glue bead D does not smear in any manner.

Referring to FIG. 6, the means for applying adhesive D to the paper blank P is more clearly disclosed. The sheet of paper P is moved under glue guns 100 which apply adhesive D to the side strips along edges E so that when the main panels of the envelope are folded together they will be adhered together by the adhesive D. The sheet P is then passed underneath the glue units 8. Each glue nozzle unit 8 may be pivotally mounted on a pivoted arm 110 which is in the raised position when the glue dots D are to be applied to the seal flap panel H thereby elevating the tips 11 out of the path of the paper P which moves beneath the tips 11 in spaced relationship thereto. The position of the arm 110 at that time is shown in broken lines in FIG. 6. As explained hereinbefore, as each sheet P passes the nozzle units 8 the paper is bowed up by deflectors 19 and moved into contact with the nozzle tips 11 so that the dots of glue D are applied to the seal flap panel H.

When the nozzle tips 11 are deactivated and not applying glue to any sheets of paper, the glue at the tips 11 of the nozzle units 8 tends to harden so that when they are reactivated to be used again there is a certain amount of lag time until the glue must be made to flow. In order to avoid the glue from hardening during this lag time, means are provided to prevent the glue from hardening. In the preferred embodiment shown in FIG. 6, these means comprise a moistener sponge assembly 111 mounted beneath the paper path. The moistener assembly 111 comprises a container 113 having a sponge 112 (or some other moisture retaining means) therein. The container 113 is mounted on and depends from the paper support mechanism 115 and has an opening 114 at the top through which the nozzle assembly 8 may pass. When the nozzle units 8 are in non-operative deactivated state, the nozzle units 8 are moved downwardly by the arm 110 so that they protrude through opening 114 and move the tips 11 of the nozzle units 8 into the moist sponge 112. As shown in the drawing, the tips 11 are embedded in the moist sponge 112. This will not only clean the nozzle tips 11 of any excess adhesive but will keep the adhesive moist and prevent the glue from hardening. Hence, when the nozzle tips 11 are reactivated to be used again, the glue is soft and ready to flow and apply glue dots D to a seal flap panel H without any loss of time.

As set forth above, the use of a moist sponge 112 to prevent the glue at the nozzle tip from hardening is the preferred means of preventing the glue from hardening. However, it is within the scope of the present invention to use any media to prevent air from contacting the nozzle tip 11 and hardening the glue that remains in the nozzle tip 11. For example, water (or some other liquid) may be substituted for the sponge or the tip 11 may be embedded in an air free atmosphere (such as a vacuum) to prevent the glue from drying.

Referring to FIGS. 7-9 of the drawing which show a preferred embodiment of the present invention, a guide rod 50, a positioning rod 51 and the front stop 22 are mounted on the folding mechanism as is usual in such folding mechanisms. In this embodiment the front stop 22 is adjustable horizontally along rods 50-51 and a ramp 53 is mounted on the rear face of front stop 22. The ramp 53 is inclined downwardly and away from the path of the oncoming paper P. As the leading edge F of the paper P moves forward and strikes the inclined ramp 53, front panel A will start to bow or bubble upwardly as at M until it strikes the adhesive charges D on nozzles 8-11 and deposits the dots of glue D on the panel A. When the paper P is moved back (as part of the folding process), the bubble or bow M moves away from the nozzles 8-11 leaving the dots of glue D on the paper without smearing the glue. The movement of the paper away from the nozzles 8-11 is in a direction substantially perpendicular to the position of the nozzles 8-11 is in a direction substantially perpendicular to the position of the nozzles 8-11 so that when the bubble or bow M moves away from the nozzle 8-11, the glue is not smeared on the paper P. It will be noted that by moving the front stop 22 and its inclined ramp 53 forward or backward along the rods 50-51 and locking it in place by knob screw 54, the paper P may be made to strike the inclined ramp 53 sooner or later in order to permit the position of the glue dots D on the paper P to be adjusted.

In addition, the present invention permits adjustment of the height of the bubble or bow M so that the position of the dots D on the paper P may also be adjusted in this manner. This adjustment mechanism comprises a flexible rod 60 (which may be wire, stainless steel cable or any other rod which may be easily bent in one direction or the other) and rod bending assembly 61 movable along the rod 51. The bending assembly 61 comprises a body portion 62 and a pair of bending wires 63–64 depending therefrom at right angles to the path of movement of the bending assembly 61. The flexible rod 60 is threaded under and over the bending wire 64–63 so that the forward part 66 of the flexible rod 60 is at a higher level than the rear part 67 and the rod is bent at 65 between wires 64–63. This higher level of the front part 66 permits the bubble or bow M of the paper P to move upwardly and into contact with the beads of glue D. It will be noted that the higher the level of the front portion 66 the greater the movement permissible in the bubble or bow M. The bending wires 64–63 may be moved forwardly or backwardly by bending assembly 61 and locked in place by a knob screw 69 so that the height of the bubble or bow M can be adjusted. If the bending assembly 61 is moved forwardly, the wire 66 is at a higher level leaving room for the bubble or bow M to be higher. If it is moved backwardly, the bubble or bow M can be lower. Hence, by moving the bending assembly 61 forwardly or backwardly, the height of the bubble or bow M may be easily adjusted. As set forth above, the paper stop 22 may also be adjusted forwardly or backwardly so that in conjunction with adjustment of the bending assembly 61, the position of the glue dots D on the paper P may be easily adjusted.

It will be seen that the present invention provides an improved means and method of making a sealed envelope in which all flaps are adhered together in a single piece, in which the adhesive is expeditiously applied to the envelope with no danger of smearing, in which the location of the adhesive may be easily adjusted and in which the glue in the nozzle is maintained in a condition where it may be used immediately when needed.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for applying adhesive to an article having a plane comprising means for forming a charge of adhesive, means for moving the article in a path, means for moving the charge-forming means and at least a portion of the article relative to each other to cause the charge of adhesive to be deposited on said article, means for deactivation and reactivation of said charge-forming means, means for maintaining the adhesive in said charge-forming means in usable condition during deactivation of said charge-forming means whereby the adhesive charge may be immediately deposited on an article immediately upon reactivation of said charge-forming means, means for moving the portion of the article away form said charge-forming means after the charge of adhesive is deposited on the article, said maintaining means and said charge-forming means being movable relative to each other to come in contact with each other, said charge-forming means being adapted to be embedded in said maintaining means, and means for forming a bow in the article to move it toward the charge-forming means.

2. A mechanism as set forth in claim 1 wherein means are provided to move the charge-forming means into said maintaining means.

3. A mechanism as set forth in claim 2 wherein said moving means move the charge-forming means past the path of the article and into contact with the maintaining means.

4. A mechanism as set forth in claim 3 wherein said maintaining means comprises a container mounted below the path of the article.

5. A mechanism as set forth in claim 4 wherein said charge-forming means are nozzles and wherein said nozzles are embedded into the maintaining means.

6. A mechanism as set forth in claim 5 wherein said maintaining means comprises a wet absorbent material.

7. A mechanism as set forth in claim 6 wherein said maintaining means comprises a wet sponge.

8. A mechanism as set forth in claim 7 wherein said article is a sheet of paper having a front edge.

9. A mechanism as set forth in claim 8 wherein the front edge of the article is moved past said charge-forming means and wherein said charge-forming means are spaced from the said front edge when the article moves past said charge-forming means.

10. A mechanism as set forth in claim 9 wherein said sheet of paper comprises front, back and seal flap panels adapted to be folded together to form an envelope.

11. A mechanism as set forth in claim 10 wherein folding means are provided to fold said paper into an envelope and wherein said nozzles apply a charge of adhesive to the seal flap panel.

12. A mechanism as set forth in claim 11 wherein means are provided to apply adhesive to the side edges of the paper to seal them when the paper is folded.

13. A mechanism as claimed in claim 12 wherein said nozzles are mounted on an arm movable to move the nozzles from a position above the path of the paper to a position below the path of the paper and into said sponge.

14. A mechanism as claimed in claim 13 wherein said maintaining means comprises means for preventing air from reaching the adhesive in said charge-forming means.

15. A mechanism as claimed in claim 14 wherein said maintaining means comprises a liquid into which the charge-forming means is moved.

16. A mechanism as set forth in claim 1, wherein means are provided for moving the bow away from the charge forming means after the adhesive has been applied.

17. A mechanism as set forth in claim 16, wherein said bow forming means comprise a front stop for the article.

18. A mechanism as set forth in claim 17, wherein said front stop is adjustable relative to the plane of the article.

19. A mechanism as set forth in claim 18, wherein said front stop has an inclined surface adapted to be engaged by the article to cause the article to form said bow.

20. A mechanism as set forth in claim 19, wherein said inclined surface is inclined away and downwardly from the plane of the article.

21. A mechanism as set forth in claim 20, wherein means are provided to adjust the height of the bow formed in the article.

22. A mechanism as set forth in claim 21, wherein said adjustment means comprise an adjustment rod movable toward and away from the article, wherein said adjustment rod may be bent upwardly to permit the bow in the article to assume different heights.

23. A mechanism as set forth in claim 22, wherein said adjustment means comprises a bending mechanism.

24. A mechanism as set forth in claim 23, wherein said bending mechanism comprises means to bend so that the forward end of the rod is higher than the rear end.

25. A mechanism as set forth in claim 24, wherein said bending means comprises a pair of bending wires at an angle to the adjustment rod.

26. A mechanism as set forth in claim 25, wherein said bending mechanism is movable along a path parallel to the plane of the article to permit the height of the forward end of the adjustment rod to bend upwardly for different heights.

27. A mechanism for applying adhesive to an article having a plane comprising means for forming a charge of adhesive, means for moving at least a portion of the article toward the charge-forming means and into contact with said charge-forming means to cause the charge of adhesive to be deposited on the article, means for moving the said portion of the article away from the charge-forming means after the adhesive has been deposited thereto, means for forming a bow in the article to move it toward the charge-forming means, means for moving the bow away from the charge-forming means after the adhesive has been applied, said bow forming means comprising a front stop for the article.

28. A mechanism as set forth in claim 27, wherein said front stop is adjustable relative to the plane of the article.

29. A mechanism as set forth in claim 28, wherein said front stop has an inclined surface adapted to be engaged by the article to cause the article to form said bow.

30. A mechanism as set forth in claim 29, wherein said inclined surface is inclined away and downwardly from the plane of the article.

31. A mechanism as set forth in claim 30, wherein means are provided to adjust the height of the bow formed in the article.

32. A mechanism as set forth in claim 31, wherein said adjustment means comprise an adjustment rod movable toward and away from the article, wherein said adjustment rod may be bent upwardly to permit the bow in the article to assume different heights.

33. A mechanism as set forth in claim 32, wherein said adjustment means comprises a bending mechanism.

34. A mechanism as set forth in claim 33, wherein said bending mechanism comprises means to bend so that the forward end of the rod is higher than the rear end.

35. A mechanism as set forth in claim 34, wherein said bending means comprises a pair of bending wires at an angle to the adjustment rod.

36. A mechanism as set forth in claim 35, wherein said bending mechanism is movable along a path parallel to the plane of the article to permit the height of the forward end of the adjustment rod to bend upwardly for different heights.

* * * * *